US010478692B2

(12) United States Patent
Gotshall

(10) Patent No.: US 10,478,692 B2
(45) Date of Patent: Nov. 19, 2019

(54) GOLF CLUB PROTECTOR

(71) Applicant: Thomas J. Gotshall, Bloomfield Hills, MI (US)

(72) Inventor: Thomas J. Gotshall, Bloomfield Hills, MI (US)

( * ) Notice: Subject to any disclaimer, the term of this patent is extended or adjusted under 35 U.S.C. 154(b) by 0 days.

(21) Appl. No.: 15/969,398

(22) Filed: May 2, 2018

(65) Prior Publication Data

US 2018/0318683 A1 Nov. 8, 2018

Related U.S. Application Data

(60) Provisional application No. 62/500,800, filed on May 3, 2017.

(51) Int. Cl.
*A63B 60/62* (2015.01)
*A63B 55/40* (2015.01)

(52) U.S. Cl.
CPC ..... *A63B 60/62* (2015.10); *A63B 55/40* (2015.10); *A63B 2209/10* (2013.01); *A63B 2225/09* (2013.01)

(58) Field of Classification Search
CPC ..... A63B 55/404; A63B 60/62
USPC ..... 206/315.4, 315.6; 150/160
See application file for complete search history.

(56) References Cited

U.S. PATENT DOCUMENTS 2,065,693 A * 12/1936 Haserodt ..... A63B 55/404 206/315.4
2,396,021 A * 3/1946 Schloss ..... A63B 60/62 150/160
2,471,169 A * 5/1949 Salzberg ..... A63B 55/00 206/315.4
3,967,667 A * 7/1976 Robinson ..... A63B 55/00 206/315.6
4,174,747 A * 11/1979 Boles ..... A63B 55/00 206/315.6
4,208,227 A * 6/1980 Cowan ..... A63B 55/00 206/315.6
4,699,164 A * 10/1987 Pilney ..... A63B 55/406 135/16
5,280,798 A * 1/1994 Helm ..... A63B 55/406 135/16
5,988,378 A * 11/1999 Bell, Jr. ..... A63B 55/00 206/315.2
6,202,840 B1 * 3/2001 Chang ..... A63B 55/00 206/315.4
9,839,825 B1 * 12/2017 Watkins ..... A63B 60/62
(Continued)

*Primary Examiner* — Sue A Weaver

(74) *Attorney, Agent, or Firm* — Honigman LLP; Matthew H. Szalach; Jonathan P. O'Brien

(57) ABSTRACT

A system for protecting a golf club is provided. The system includes a carrier having a first surface and a second surface disposed on an opposite side of the carrier than the first surface. The carrier is selectively movable between a constricted state wrapped around the at least one golf club and a relaxed state. The system also includes at least one sleeve depending from one of the first surface and the second surface and including a first opening disposed at a first end of the at least one sleeve that receives a head of the at least one golf club. The at least one sleeve may be surrounded by the carrier when the carrier is in the constricted state. A fastener may be supported by the carrier to selectively maintain the carrier in the constricted state.

16 Claims, 8 Drawing Sheets

(56) References Cited

U.S. PATENT DOCUMENTS

2003/0116456 A1* 6/2003 Ueno ..... A63B 55/00
206/315.3

* cited by examiner 114
112
$A_C$
106b
142
102b
130b
110b
108b
$S_R$
144c
144b
144a
S
104a-f
132

$A_C$
102b
130b
142
108b
110b
144c
144b
144a
104f
104e
104d
104c
104b
104a
104a-f

GOLF CLUB PROTECTOR

CROSS-REFERENCE TO RELATED APPLICATIONS

This application claims priority to U.S. Provisional Application Ser. No. 62/500,800, filed May 3, 2017 the disclosure of which is incorporated herein by reference in its entirety.

FIELD

The present disclosure relates to a device for protecting golf clubs during transit.

BACKGROUND

A golfer generally enjoys having the opportunity to play different golf courses. In order to play different courses, a golfer often has to travel and, thus, to transport golf clubs. Such transportation includes local transport generally via car, bus, or bike as well as longer-distance travel typically via plane or train. Such travel—either local or longer-distance travel—may result in damage to one or more of the golf clubs caused by the golf clubs contacting one another and/or contacting external objects (i.e., objects disposed within a trunk of a vehicle or within a cargo hold of an airplane).

Conventional travel golf bags and covers are available that offer a degree of protection to a golfer's golf clubs and golf bag. Such travel golf bags and covers typically receive a golf bag and golf clubs within an interior of the travel bag as a single unit so that the golf clubs and bag are ready for immediate use once they reach their destination.

While conventional travel golf bags and covers adequately protect golf clubs from contacting external structures during transit, such travel bags and covers do little to protect golf clubs from contacting and damaging one another during transit.

SUMMARY

This section provides a general summary of the disclosure, and is not a comprehensive disclosure of its full scope or all of its features.

One aspect of the disclosure provides a system for receiving at least one golf club. The system includes a carrier having a first surface and a second surface disposed on an opposite side of the carrier than the first surface. The carrier is selectively movable between a constricted state wrapped around the at least one golf club and a relaxed state. The system also includes at least one sleeve depending from one of the first surface and the second surface and includes a first opening disposed at a first end of the at least one sleeve that receives a head of the at least one golf club. The at least one sleeve may be surrounded by the carrier when the carrier is in the constricted state. A fastener may be supported by the carrier to selectively maintain the carrier in the constricted state.

Implementations of the disclosure may include one or more of the following optional features. In some implementations, the fastener includes a first portion attached to the first surface of the carrier and the second portion attached the second surface of the carrier. The first portion may be disposed proximate to a first end of the carrier and the second portion may be disposed proximate to a second end of the carrier. The second end may be disposed at an opposite end of the carrier than the first end. The fastener may be one of a hook-and-loop fastener, a snap, or a buckle.

In some examples, the at least one sleeve includes a second opening disposed at a second end of the at least one sleeve. The second end may be disposed at an opposite end of the at least one sleeve than the first end. The second opening may be smaller than the first opening. The second opening may include a different shape than the first opening.

In some implementations, the carrier extends along a first longitudinal axis and the at least one sleeve extends along a second longitudinal axis. The second longitudinal axis may be substantially perpendicular to the first longitudinal axis. The length of the at least one sleeve along the second longitudinal axis may be substantially equal to a width of the carrier.

Another aspect of the disclosure provides a system for receiving at least two golf clubs. The system includes a carrier having a first surface and a second surface disposed on an opposite side of the carrier than the first surface. The carrier is selectively movable between a constricted state wrapped around the at least two golf clubs and a relaxed state. The system also includes at least two sleeves depending from one of the first surface and the second surface and spaced apart from one another in a direction extending along a longitudinal axis of the carrier. The at least two sleeves each include a first opening disposed at a first end of the at least two sleeves that receives respective ones of the at least two golf clubs. The at least two sleeves are each surrounded by the carrier when the carrier is in the constricted state.

This aspect may include one or more of the following optional features. In some implementations, a fastener is supported by the carrier and selectively maintains the carrier in the constricted state. The fastener may include a first portion attached to the first surface of the carrier and a second portion attached to the second surface of the carrier. The first portion may be disposed proximate to a first end of the carrier and the second portion may be disposed proximate to a second end of the carrier. The second end may be disposed at an opposite end of the carrier than the first end. The fastener may be one of a hook-and-loop fastener, a snap, and a buckle.

In some examples, the at least two sleeves each include a second opening disposed at a second end of the at least two sleeves. The second end is disposed at an opposite end of the at least two sleeves than the first end. The second opening may be smaller than the first opening. The second opening may include a different shape than the first opening. The at least two sleeves may extend along respective second longitudinal axes where the second longitudinal axes are substantially perpendicular to the longitudinal axis of the carrier. A length of the at least two sleeves along the second longitudinal axes may be substantially equal to a width of the carrier.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1A:
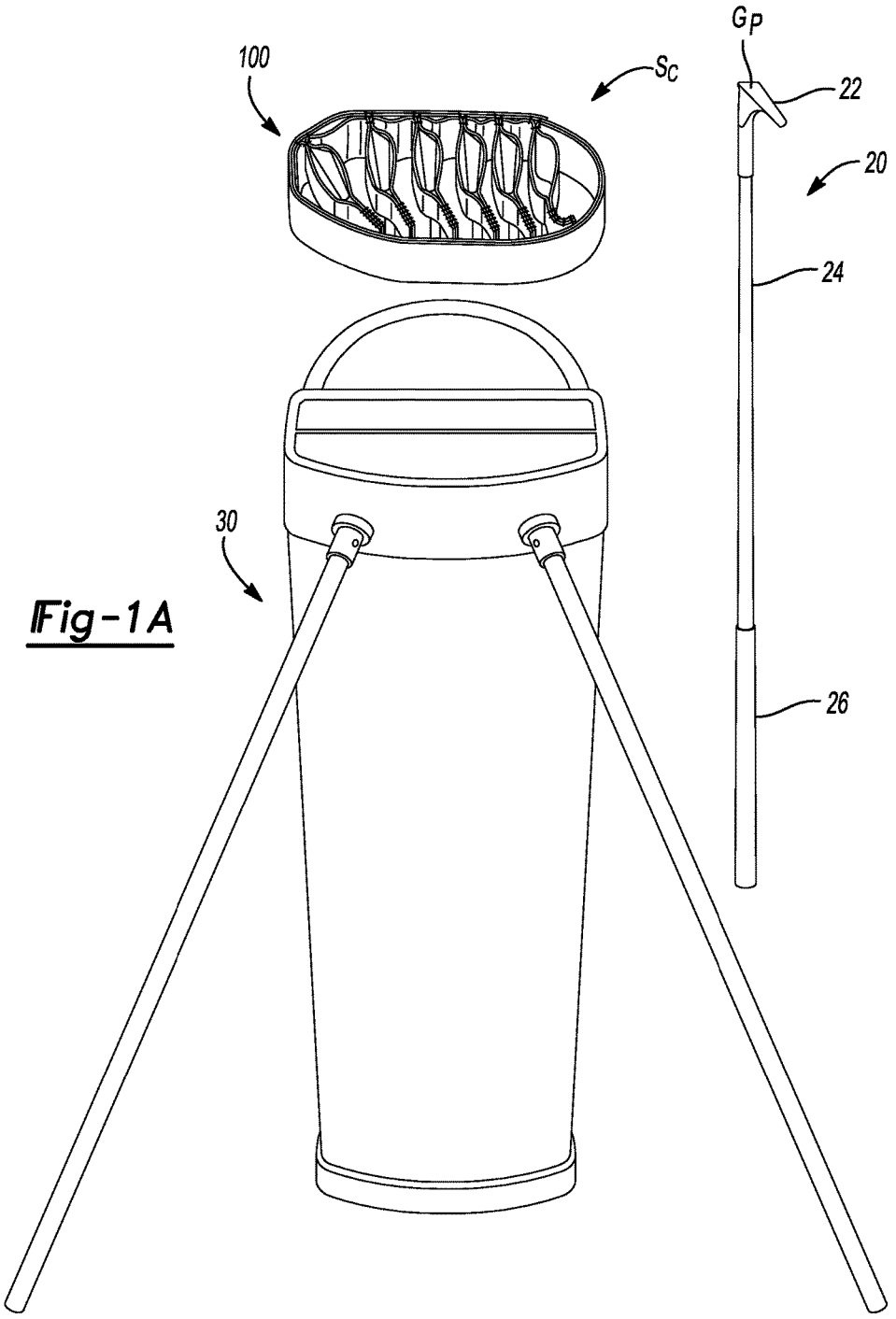
FIG. 1A is a perspective view of a golf club protector in accordance with the principals of the present disclosure shown in relation to a golf bag and a golf club prior to attachment to the golf club.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

With reference to FIG. 1A, a golf club 20 and a golf bag 30 are shown in conjunction with a golf club protector 100. The golf club 20 has a head portion 22, a shaft portion 24, and a grip portion 26. Generally, the golf bag 30 receives the golf club 20 at the shaft portion 24 and the grip portion 26 when the club 20 is stored in the bag 30. In some examples, the golf bag 30 receives a collection 32 (e.g., FIGS. 1B-1D) of golf clubs 20. The golf club 20 or the collection 32 of more than one golf club 20 may include various types of golf clubs configured for particular purposes, such as drivers (or woods), irons, wedges, putters, and/or hybrid golf clubs. Similarly, the golf bag 30 may include different varieties of golf bags depending on a particular golf outing or a golfer's equipment. For example, the golf bag 30 may be a staff bag, a cart bag, a stand bag (e.g., FIG. 1A), a carry bag, or a travel bag. Regardless of the particular golf club 20 or golf bag 30 used, the golf club protector 100 may be used to protect the golf clubs 20 from contacting one another. Namely, and as will be described in detail below, in a constricted state $S_C$, the golf club protector 100 wraps around one or more golf clubs 20 and may accompany the one or more golf clubs 20 in the golf bag 30 (e.g., FIG. 1A). While the protector 100 may be used with any type of golf club 20, the protector 100 will be described and shown hereinafter as being used in conjunction with a set of irons, as other clubs such as woods and putters typically include a head cover and are therefore protected during transit.

Figure 1B:
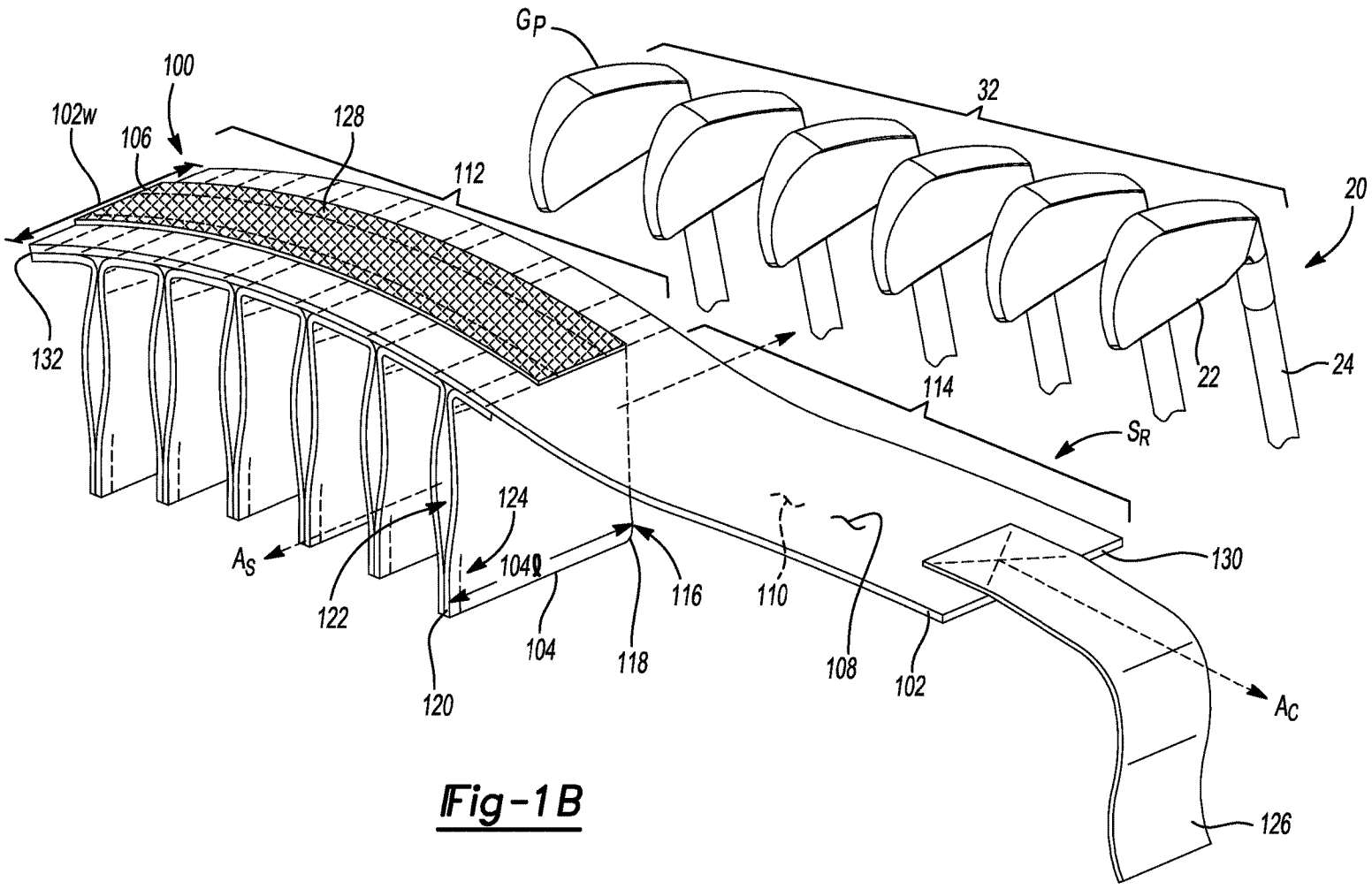
FIG. 1B is a perspective view of a golf club protector in accordance with the principles of the present disclosure prior to receiving a golf club.
Figure 1C:
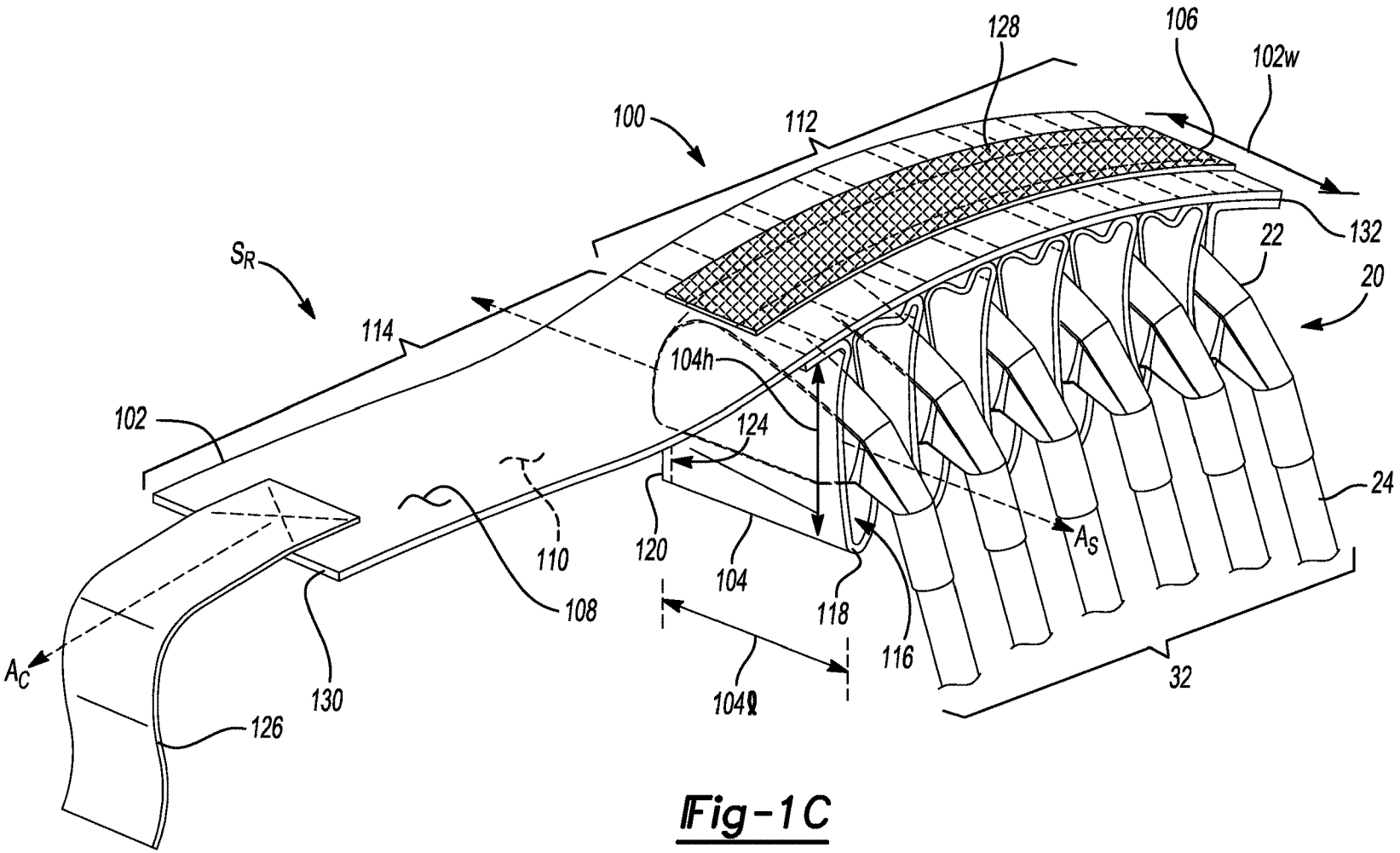
FIG. 1C is a perspective view of the golf club protector of FIG. 1B shown in conjunction with a plurality of golf clubs.
Figure 1D:
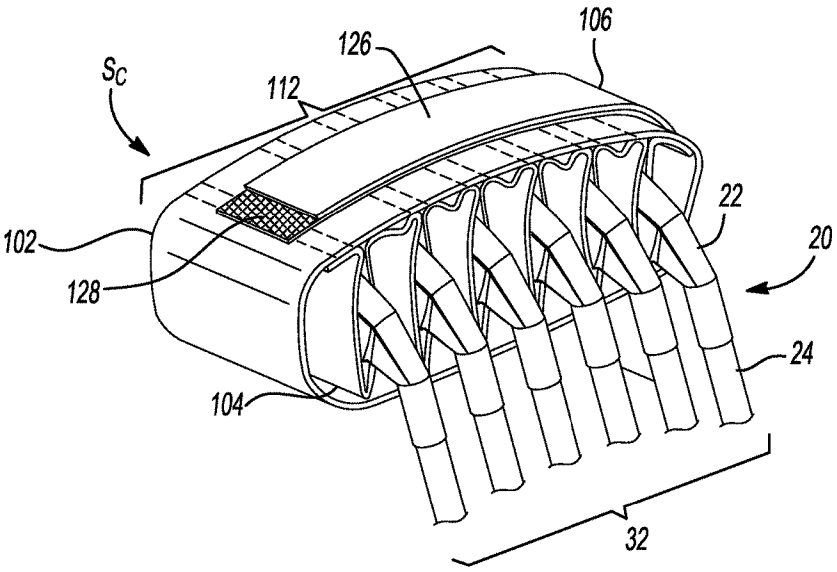
FIG. 1D is a perspective view of the golf club protector of FIGS. 1B and 1C in a constricted state.

With reference to FIGS. 1B-1D, the golf club protector 100 is shown as including a carrier 102, at least one sleeve 104, and a fastener 106. The carrier 102 includes a first surface 108 and the second surface 110 disposed on an opposite side of the carrier 102 than the first surface 108. The carrier 102 has a width 102*w* and a length 102*l* along a carrier axis $A_C$. The carrier 102 is selectively movable between a relaxed state $S_R$ (e.g., FIGS. 1B and 1C) and a constricted state $S_C$ (e.g., FIG. 1D). In the constricted state $S_R$, the carrier 102 is wrapped around at least one golf club 20.

In some examples, the carrier 102 is constructed from a material that protects a golf club 20 having a head 22 disposed therein while being flexible enough to permit the carrier 102 to wrap around the club 20. The carrier 102 may include a protection portion 112 covering the head portion 22 of the golf club 20 such that a ground plane $G_P$ of the head portion 22 faces the protection portion 112 and a flexible portion 114 that selectively wraps around the golf club 20. The carrier 102 may be constructed from a material that is woven, nonwoven, or a hybrid of both. The woven or the nonwoven material may be a natural material (e.g., an animal-based fiber or cellulosic fiber, such as leather, hemp, jute, wood pulp, etc.), a synthetic material (e.g., nylon, polyester, aramid, synthetic leather, etc.), or a combination of both. In some implementations, the carrier 102 is a unitary construction formed from a single sheet or web of material. In other implementations, the carrier 102 is a hybrid construction formed from multiple materials.

The protection portion 112 and the flexible portion 114 of the carrier 102 may have similar or different properties. As an example, the flexible portion 114 may have less rigidity than the protection portion 112 and may be an elastic material, such as latex or nylon, to allow the flexible portion 114 to wrap around the one or more golf clubs 20. The protection portion 112 may be formed from a material that is more rigid and/or is more cable of attenuating impact forces than a material of the flexible portion 114 to allow the protection portion 112 to absorb or deflect impact and vibration forces generated during movement of the one or more golf clubs 20, thereby preventing damage to the clubs 20 when disposed within the golf club protector 100.

Additionally or alternatively, the carrier 102 may be made from more than one layer of material. With more than one layer, a manufacturer of the golf club protector 100 can vary an amount of layers in different portions of the carrier 102 or may select a stack-up of layers to achieve a desired rigidity in different portions of the carrier 102 (e.g., the protection portion 112 and the flexible portion 114). In some examples, the carrier 102 may include at least three layers where an inner layer has a different rigidity than outer layers corresponding to the first surface 108 and the second surface 110. The inner layer may have greater rigidity to provide stiffness to the protection portion 112 and/or the flexible portion 114 of the golf club protector 100. The outer layers may be less rigid than the inner layer to permit attachment of the at least one sleeve 104 (e.g., by sewing or by stitching) to at least one of the first surface 108 and the second surface 110. For example, the inner layer may be an insert sewn or stitched between outer layers respectively defining the surfaces 108, 110. With more than one layer, the first surface 108 and the second surface 110 of the carrier 102 may be constructed from similar materials or different materials; thus, the first surface 108 and the second surface 110 may vary in stiffness and/or rigidity relative to one another.

Referring further to FIGS. 1B-1D, the golf club protector 100 includes the at least one sleeve 104 having a length **104*l* along a sleeve axis $A_S$. The at least one sleeve 104 depends from one of the first surface 108 and the second surface 110. For example, the at least one sleeve 104 may be fastened along a width 102*w* of the carrier 102 on one of the first surface 108 and the second surface 110 that faces the ground plane $G_P$ of the at least one golf club 20 during use. In some examples, the carrier 102 extends along a first longitudinal axis (i.e. the carrier axis $A_C$) and the at least one sleeve 104 extends along a second longitudinal axis (i.e. the sleeve axis $A_S$) that is substantially perpendicular to the first longitudinal axis. In one configuration, the length 104*l* of the at least one sleeve 104 may be substantially equal to the width 102*w* of the carrier 102. The at least one sleeve 104 may be sown, stitched, riveted, heat sealed, ultrasonic welded, woven, or otherwise adhered to the carrier 102 at the second surface 110**.

Referring to FIGS. 1B-1D and FIGS. 2B-2C, the at least one sleeve 104 includes a first opening 116 at a first end 118 operable to receive the head portion 22 of a golf club 20. The first opening 116 may span a height **104*h* (e.g., FIG. 1C) of the at least one sleeve 104. In some examples, at a second end 120 of the at least one sleeve 104 opposite the first end 118, the at least one sleeve 104 includes a second opening 122. In these examples, the second opening 122 is located at the second end 120 of the at least one sleeve 104 opposite the shaft portion 24 of the at least one golf club 20 upon insertion. The first opening 116 and the second opening 122 may be similar sizes or different sizes. In some implementations, the second opening 122 is smaller than the first opening 116 to prevent the head portion 22 from traveling past the second end 120 upon insertion of the head 22 into the sleeve 104 and to prevent exposure of the head portion 22 outside the sleeve 104. For example, the second opening 122 is at least partially stitched or sewn along the height 104*h* at the second end 120 in a second opening area 124. Additionally or alternatively, the second opening 122 includes a different shape than the first opening 116**.

Additionally or alternatively, the sleeve 104 may taper along the length **104*l* of the sleeve 104. The taper may define a secure fit or a pressure fit to restrict movement of the head portion 22 of the golf club 20 relative to a respective one of the sleeves 104 when the golf club 20 is inserted into the sleeve 104. In some examples, an attachment surface corresponding to at least one of the first surface 108 and the second surface 110 permits the sleeves 104 to selectively attach and detach from the carrier 102. For example, the attachment surface may include at least one of a hook-and-loop fastener while the sleeve(s) 104 includes the other of the hook-and-loop fastener to selectively couple with the attachment surface. A modular design of the sleeve(s) 104 makes the golf club protector 100 adaptable to different types of clubs and/or different quantities of clubs a golfer desires to protect. While the one or more sleeves 104 may be removably attached to the carrier 102, the one or more sleeves 104 will be described and shown hereinafter as being fixedly attached to the carrier 102**.

Referring further to FIGS. 1B-1D and 2A-2C, the golf club protector 100 includes the fastener 106 that selectively maintains the carrier 102 in the constricted state $S_C$. The carrier 102 supports the fastener 106 such that the fastener 106 is attached to the carrier 102 (e.g., by stitching, by adhesive, etc.) or the fastener 106 is the carrier 102 itself. In some implementations, the fastener 106 includes a first portion 126 attached to the first surface 108 or the second surface 110 of the carrier 102 and a second portion 128 attached to the first surface 108 of the carrier 102. As shown in FIG. 1B, the first portion 126 is attached to the first surface 108. The first portion 126 and the second portion 128 of the fastener 106 may correspond to a region or regions within the flexible portion 114 and the protection portion 112, respectively.

The first portion 126 may be disposed proximate to a first end 130 of the carrier 102 and the second portion 128 may be disposed proximate to a second end 132 of the carrier 102. For example, the proximity between the portions 126 and 128 and the ends 130 and 132 may range from a minimal proximity such that the portions 126 and 128 are substantially coplanar to the ends 130 and 132 to a maximum proximity where the portions 126 and 128 are within 30% of a length of the carrier 102 from the ends 130 and 132. As depicted in FIGS. 1-3, the first portion 126 of the fastener 106 may be constructed from or may include one portion of a hook-and-loop fastener while the second portion 128 of the fastener 106 includes a mating compliment of the hook-and-loop fastener of the first portion 126.

FIGS. 1B-1D are examples of a progression of the golf club protector 100 between the relaxed state $S_R$ and the constricted state $S_C$. FIG. 1B illustrates a collection 32 of more than one golf club 20 prior to insertion of the clubs 20 into respective sleeves 104 of the golf club protector 100. Prior to insertion of the golf clubs 20 into the respective sleeves 104, the golf club protector 100 is in a relaxed state $S_R$. In FIG. 1C, golf club protector 100 is in the relaxed state $S_R$ with the head portion 22 of the golf clubs 20 disposed within respective sleeves 104. Upon receipt of the golf clubs 20, the sleeves 104 may span a substantial portion of the head portion 22 of the respective golf clubs 20. After receipt of the golf clubs 20, the golf club protector 100 may transition from the relaxed state $S_R$ to the constricted state $S_C$ by wrapping the fastener 106 (i.e., the first portion 126) along with the flexible portion 114 around the sleeves 104. FIG. 1D illustrates the golf clubs 20 protected by the golf club protector 100 in the constricted state $S_C$, whereby the first portion 126 of the fastener 106 is removably attached to the second portion 128 of the fastener 106 to maintain the protector 100 in the constricted state $S_C$.

Figure 2A:
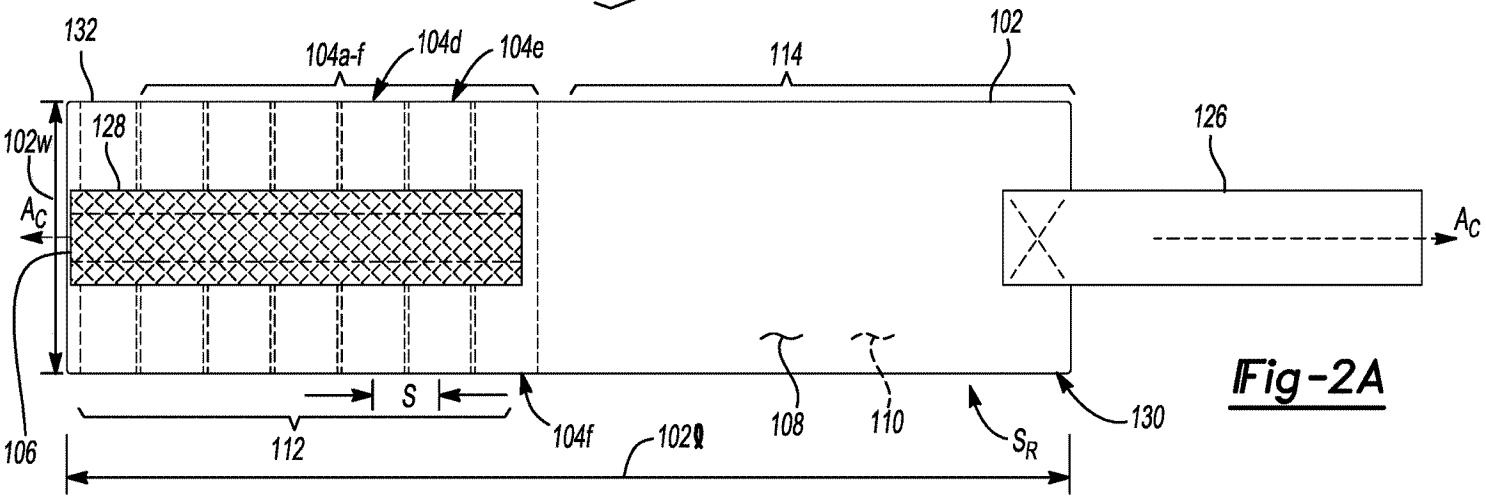
FIG. 2A is a top view of the golf club protector of FIGS. 1B-1D in a relaxed state.

FIG. 2A is a top view of the golf club protector 100 of FIGS. 1A-1D. As shown, the golf club protector 100 with width 102*w* is in the relaxed state $S_R$ and includes six sleeves 104*a-f* depending from the carrier 102. In some examples where the sleeves 104 include at least two sleeves 104, the first sleeve and the second sleeve are spaced apart from one another at a spacing S in a direction extending along a longitudinal axis (e.g., $A_C$) of the carrier 102. For example, FIG. 2A illustrates at least two sleeves (e.g., 104*d* and 104*e*) spaced apart by spacing S. Each of the six sleeves 104*a-f* is attached at the second surface 110 by sewing or stitching such that each sleeve 104 spans the width 102*w* of the carrier 102. The first portion 126 of the fastener 106 extends beyond the first end 130 of the carrier 102 such that the first portion 126 can wrap around the six sleeves 104*a-f* and secure to the second portion 128 of the fastener 106 in the constricted state $S_C$. The second portion 128 of the fastener 106 extends from the second end 132 of the carrier 102 to a region above a sixth sleeve 104*f* of the six sleeves 104*a-f*.

Figure 2B:
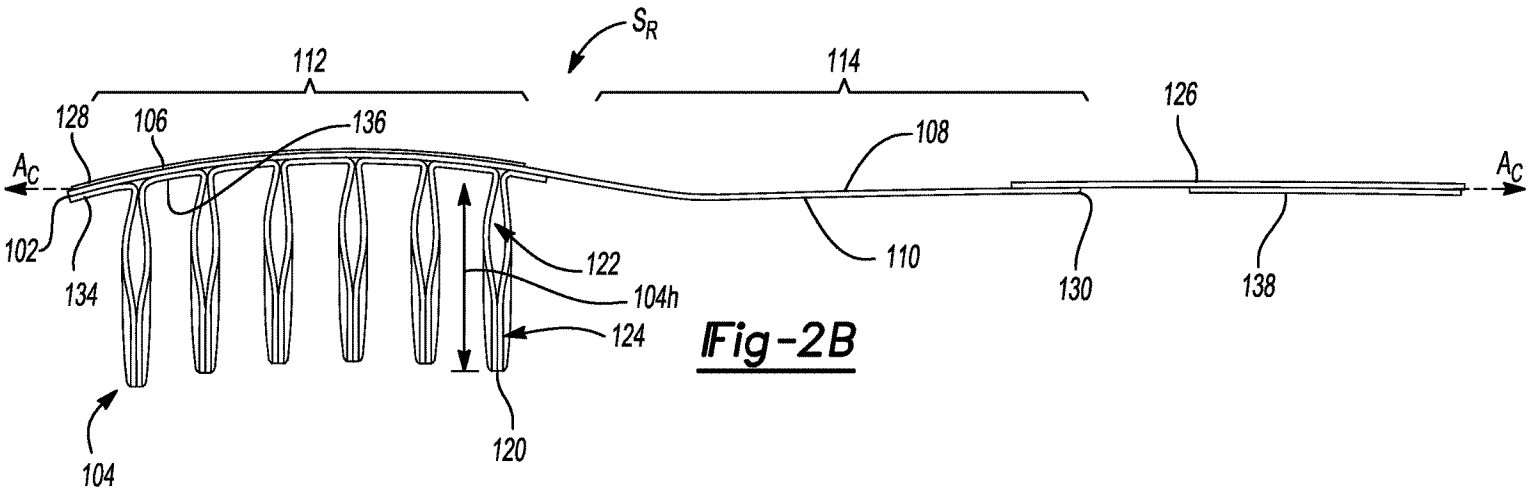
FIG. 2B is a side view of the golf club protector of FIGS. 1B-1D in a relaxed state.
Figure 2C:
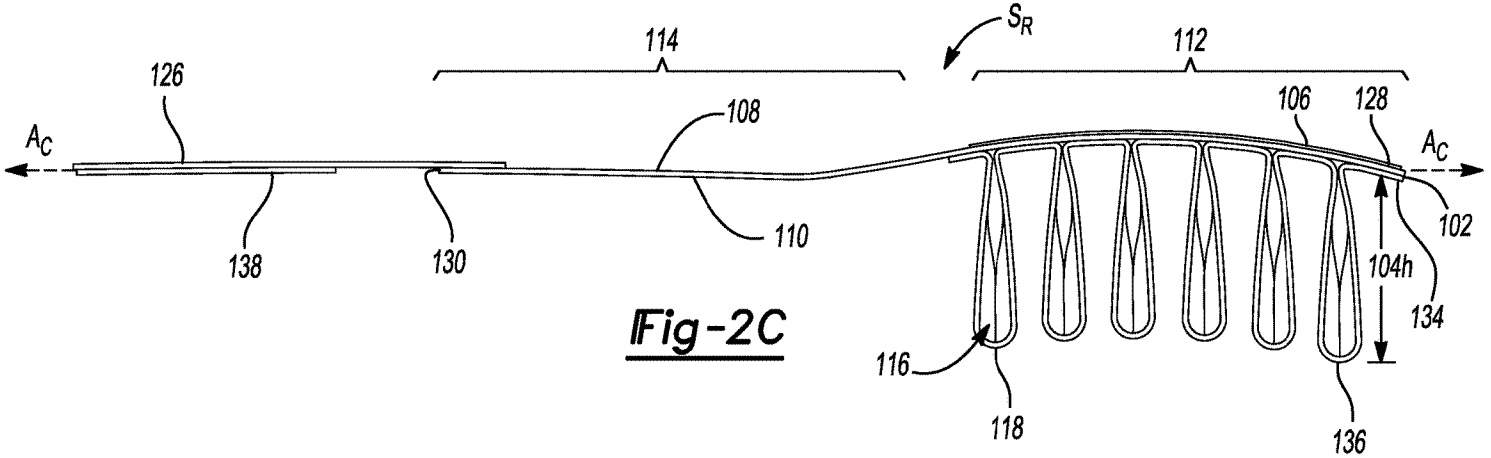
FIG. 2C is a side view of the golf club protector of FIGS. 1B-1D in a relaxed state.

FIGS. 2B-2C are side views of the golf club protector 100 of FIGS. 1A-1D. In the protection portion 112, the golf club protector 100 includes the carrier 102, the second portion 128 of the fastener 106, and the at least one sleeve 104. The second portion 128 of the fastener 106 attaches to the first surface 108 of the carrier 102. In the flexible portion 114, at the first end 130 of the carrier 102, the first portion 126 of the fastener 106 attaches to one of the first surface 108 and the second surface 110. For example, in FIGS. 2B-2C, the first portion 126 attaches to the first surface 108 of the carrier 102. The first portion 126 may include a first portion fastening layer 138 (i.e., one portion of a hook-and-loop fastener) that attaches to the second portion 128 (i.e., the other portion of the hook-and-loop fastener) and that faces the first surface 108 in the constricted state $S_C$. In such a configuration, the first portion 126 may be a substrate that supports the hook-and-loop fastener (i.e., layer 138) relative to the carrier 102.

FIGS. 2B-2C further illustrate that the first opening 116 of the at least one sleeve 104 may include a different shape than the second opening 122 of the at least one sleeve 104. For example, the first opening 116 of the at least one sleeve 104 has a substantially teardrop shape (e.g., FIG. 2C) while the second opening 122 of the at least one sleeve 104 has a substantially symmetrical shape (e.g., FIG. 2B). In the examples of FIGS. 2B-2C, each sleeve 104 of the at least one sleeve 104 is formed from a first sleeve portion 134 and a second sleeve portion 136 that is sewn or otherwise bonded together. In other examples, each sleeve 104 of the at least one sleeve 104 is formed from a single piece of material and is stitched or sewn to form the openings 116 and 122.

With reference to FIGS. 3-5, other fasteners 106*a-c* are shown for use in conjunction with the golf club protector 100. The structure and the function of the fasteners 106*a-c* may be substantially similar to that of fastener 106 apart from any exceptions described below and/or shown in the Figures. Accordingly, the description and/or the function of similar features will not be described again in detail. In addition, like reference numbers are used hereinafter and in the drawings to identify like components, while like reference numbers containing letter extensions (e.g., "a") are used to identify those features that have been modified.

Figure 3A:
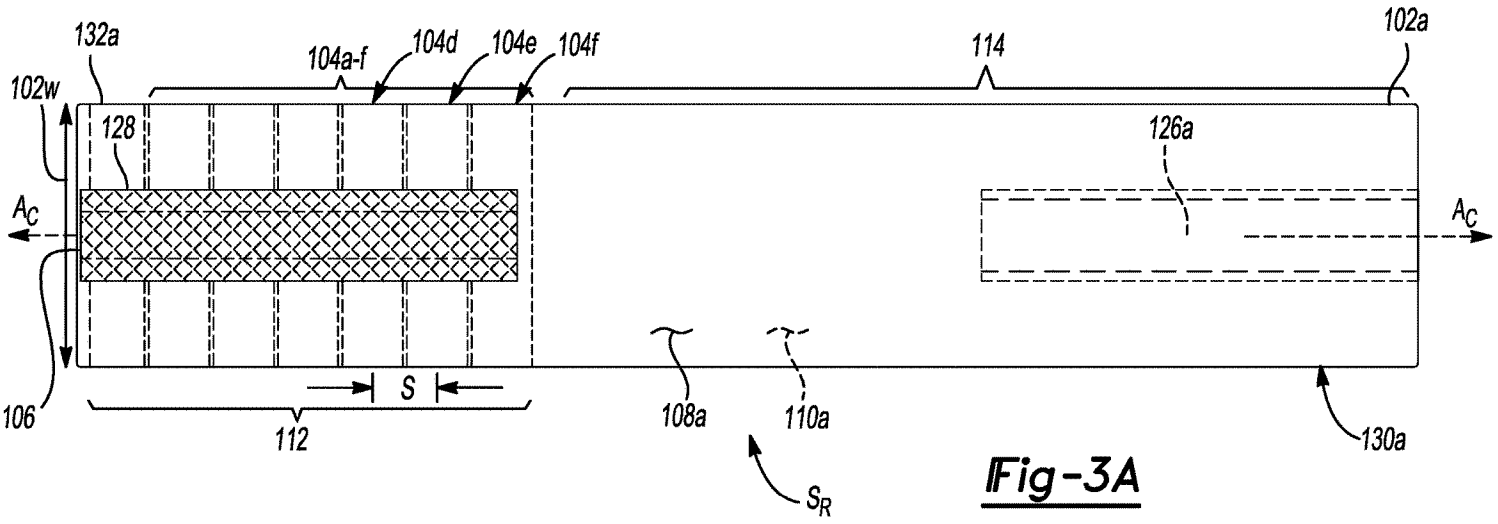
FIG. 3A is top view of a golf club protector in accordance with the principles of the present disclosure shown in a relaxed state.
Figure 3B:
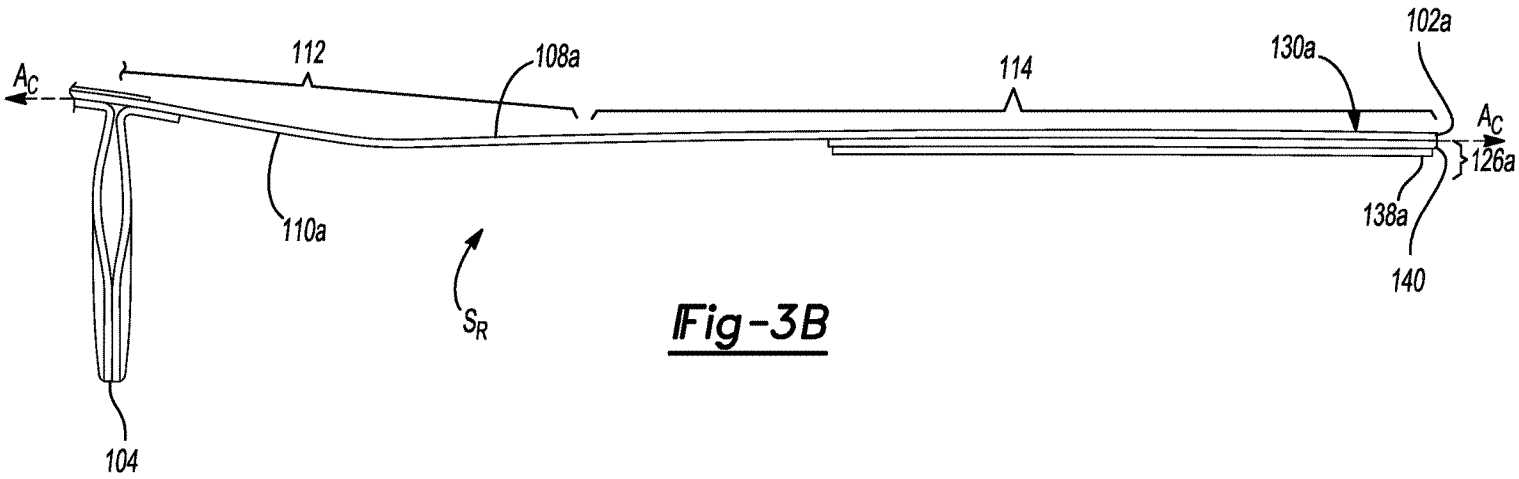
FIG. 3B is a partial side view of the golf club protector of FIG. 3A.

FIGS. 3A-3B are examples of a carrier 102*a* having a fastener 106*a* directly attached to the second surface 110*a*. The carrier 102*a* includes a first portion 126*a* attached to the second surface 110*a* of the carrier 102*a*. The first portion 126*a* of the carrier 102*a* secures to the second portion 128 in the constricted state $S_C$ in a similar fashion as described above with respect to the fastener 106.

The first portion 126*a* is disposed within the flexible portion 114 of the carrier 102*a* at a position that aligns with the second portion 128 in the constricted state $S_C$. As depicted in FIG. 3A, the first portion 126*a* may be one portion of a hook-and-loop fastener. In some examples, such as FIG. 3B, the first portion 126*a* is attached to the second surface 110*a* via a substrate or attachment layer 140 that provides a degree of rigidity and support to the first portion 126*a*.

Figures 4A, 4B:
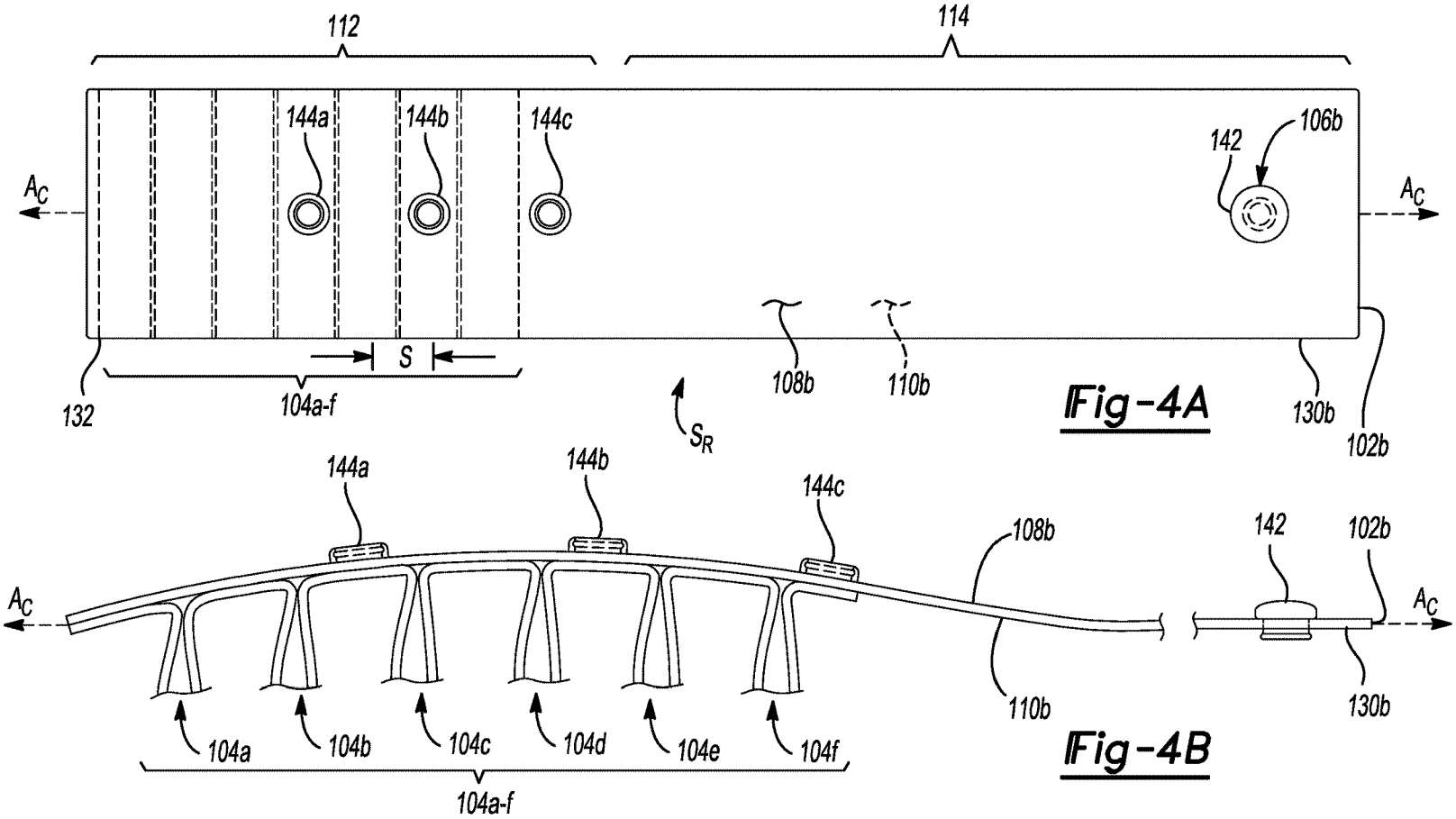
FIG. 4A is top view of a golf club protector in accordance with the principles of the present disclosure shown in a relaxed state.
FIG. 4B is a partial side view of the golf club protector of FIG. 4A.

FIGS. 4A-4B are examples of a snap fastener system 106*b* including a first snap 142 that mates with at least one second snap 144*a-c*. The first snap 142 is located within the flexible region 114 of the carrier 102*b*. As depicted in FIG. 4A, the first snap 142 is positioned towards the first end 130*b* of the carrier 102*b* such that the first snap 142 aligns with the at least one second snap 144*a-c* in the constricted state $S_C$. The first snap 142 may be attached to the second surface 110*b* of the carrier 102*b* or affixed through the carrier 102*b* (e.g., FIG. 4B). The at least one second snap 144 is located within the protection portion 112 of the carrier 102*b*. For example, FIG. 4B illustrates three second snaps 144*a-c* disposed on the first surface 108*b* of the carrier 102*b* between sleeves 104*b-c*, 104*d-e*, and between sleeve 104*f* and the flexible portion 114. The first snap 142 and the at least one second snap 144 allow the carrier 102*b* to selectively move between the relaxed state $S_R$ and the constricted state $S_C$ as the at least one second snap 144 matingly receives the first snap 142 or vice versa. Providing multiple second snaps 144*a-c* allows a user to control the degree to which the protector 100 is wrapped around the clubs 20 and, further, allows the user to adjust the amount of constriction based on the number of clubs 20 disposed within the protector 100. For example, if each sleeve 104 receives a golf club 20, the first snap 142 would likely engage the second snap 144*a*. If, on the other hand, only one or two clubs 20 are received by the sleeves 104, the first snap 142 would likely engage one of the second snaps 144*b*, 144*c* to allow the protector 100 to securely wrap around the heads 22 of the clubs 20.

Figure 5A:
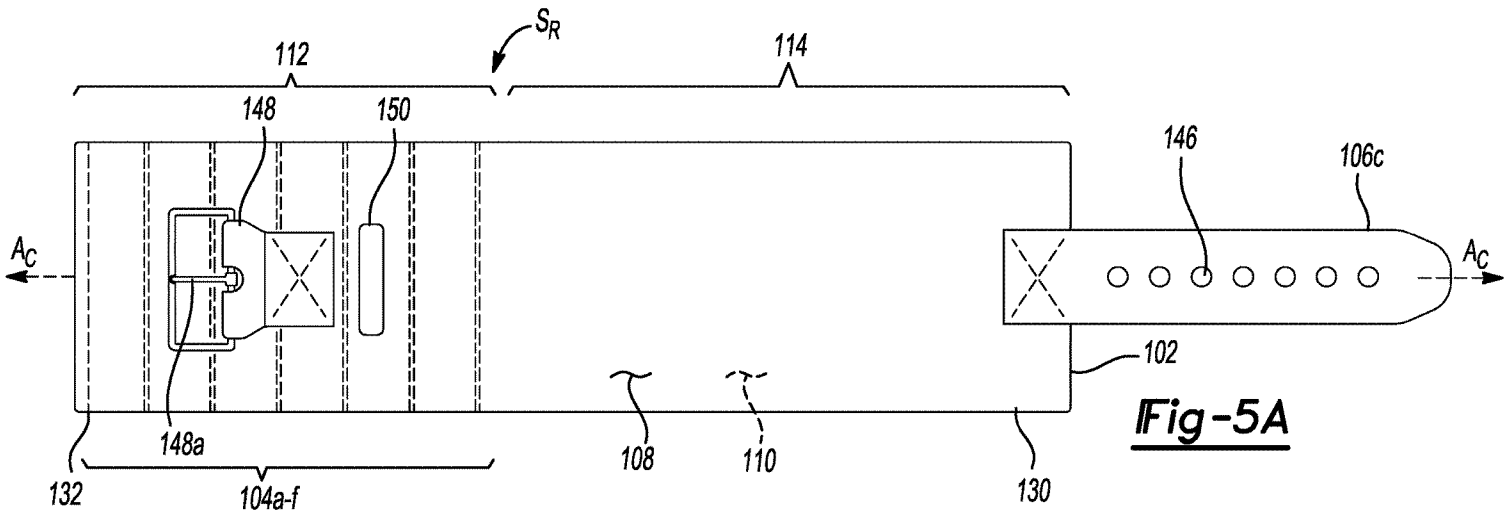
FIG. 5A is top view of a golf club protector in accordance with the principles of the present disclosure shown in a relaxed state.
Figure 5B:
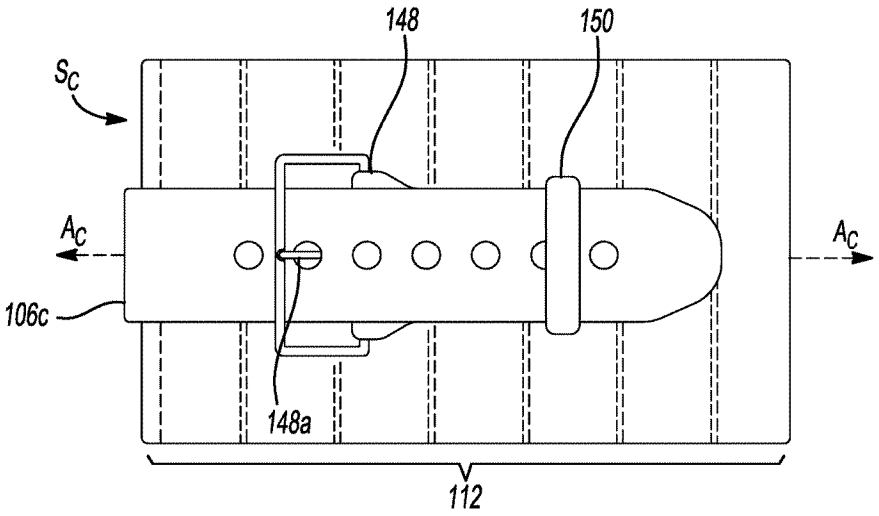
FIG. 5B is partial top view of the golf club protector of FIG. 5A.

FIGS. 5A-5B are examples of a golf club protector 100 with a belt fastener 106*c*. The belt fastener 106*c* may be attached to the carrier 102 at the first end 130 (e.g., FIG. 5A) or may be unattached and independent from the carrier 102. When attached to the carrier 102, the belt fastener 106*c* may be attached to one of the first surface 108 or the second surface 110. For example, in FIG. 5A, the belt fastener 106*c* with at least one opening 146 is shown as being attached to the first surface 108 of the carrier 102. A buckle 148 with a prong 148*a* is disposed on the first surface 108 of the carrier 102 within the protection portion 112 and is positioned to receive the belt fastener 106*c* in the constricted state $S_C$ such that the at least one opening 146 receives the prong 148*a*. In some implementations, the carrier 102 with the belt fastener 106*c* includes at least one loop 150 in the protection portion 112 of the carrier 102 to help secure the belt fastener 106*c* in the constricted state $S_C$.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A system for receiving at least one golf club, the system comprising:

a carrier including a first surface and a second surface disposed on an opposite side of the carrier than the first surface, the carrier selectively movable between a constricted state wrapped around the at least one golf club and a relaxed state;

at least one sleeve depending from one of the first surface and the second surface and including a first opening disposed at a first end of the at least one sleeve and operable to receive a head of the at least one golf club, the at least one sleeve surrounded by the carrier when the carrier is in the constricted state, and the at least one sleeve including a second opening disposed at a second end of the at least one sleeve, the second opening being smaller than the first opening and the second end being disposed at an opposite end of the at least one sleeve than the first end; and a fastener supported by the carrier and operable to selectively maintain the carrier in the constricted state.

2. The system of claim 1, wherein the fastener includes a first portion attached to the first surface of the carrier and a second portion attached to the second surface of the carrier.

3. The system of claim 2, wherein the first portion is disposed proximate to a first end of the carrier and the second portion is disposed proximate to a second end of the carrier, the second end being disposed at an opposite end of the carrier than the first end.

4. The system of claim 3, wherein the fastener is one of a hook-and-loop fastener, a snap, and a buckle.

5. The system of claim 1, wherein the second opening includes a different shape than the first opening.

6. The system of claim 1, wherein the carrier extends along a first longitudinal axis and the at least one sleeve extends along a second longitudinal axis, the second longitudinal axis being substantially perpendicular to the first longitudinal axis.

7. The system of claim 6, wherein a length of the at least one sleeve along the second longitudinal axis is substantially equal to a width of the carrier.

8. The system of claim 6, wherein the at least one sleeve includes at least two sleeves, the at least two sleeves being spaced apart from one another in a direction extending along a longitudinal axis of the carrier.

9. A system for receiving at least two golf clubs, the system comprising:

a carrier including a first surface and a second surface disposed on an opposite side of the carrier than the first surface, the carrier selectively movable between a constricted state wrapped around the at least two golf clubs and a relaxed state; and at least two sleeves depending from one of the first surface and the second surface and spaced apart from one another in a direction extending along a longitudinal axis of the carrier, the at least two sleeves each including a first opening disposed at a first end of the at least two sleeves that is operable to receive a respective head of the at least two golf clubs and each being surrounded by the carrier when the carrier is in the constricted state, wherein the at least two sleeves each include a second opening disposed at a second end of the at least two sleeves, the second opening being smaller than the first opening and the second end being disposed at an opposite end of the at least two sleeves than the first end.

10. The system of claim 9, further comprising a fastener supported by the carrier and operable to selectively maintain the carrier in the constricted state.

11. The system of claim 10, wherein the fastener includes a first portion attached to the first surface of the carrier and a second portion attached to the second surface of the carrier.

12. The system of claim 11, wherein the first portion is disposed proximate to a first end of the carrier and the second portion is disposed proximate to a second end of the carrier, the second end being disposed at an opposite end of the carrier than the first end.

13. The system of claim 12, wherein the fastener is one of a hook-and-loop fastener, a snap, and a buckle.

14. The system of claim 9, wherein the second opening includes a different shape than the first opening.

15. The system of claim 9, wherein the at least two sleeves extends along respective second longitudinal axes, the second longitudinal axes being substantially perpendicular to the longitudinal axis of the carrier.

16. The system of claim 15, wherein a length of the at least two sleeves along the second longitudinal axes is substantially equal to a width of the carrier.

* * * * *